US009995082B2

(12) United States Patent
Hsu et al.

(10) Patent No.: US 9,995,082 B2
(45) Date of Patent: Jun. 12, 2018

(54) RESTRICTION DEVICE FOR RESTRICTING WIRES FROM BEING PULLED OUT FROM SHADE

(71) Applicant: CHING FENG HOME FASHIONS CO., LTD., Fuxing Shiang, Changhua County (TW)

(72) Inventors: Sheng Ying Hsu, Fuxing Shiang (TW); Chun Jan Hsu, Fuxing Shiang (TW)

(73) Assignee: CHING FENG HOME FASHIONS CO., LTD., Changhua County (TW)

( * ) Notice: Subject to any disclaimer, the term of this patent is extended or adjusted under 35 U.S.C. 154(b) by 0 days. days.

(21) Appl. No.: 15/276,346

(22) Filed: Sep. 26, 2016

(65) Prior Publication Data

US 2017/0306695 A1 Oct. 26, 2017

(30) Foreign Application Priority Data

Apr. 25, 2016 (TW) ..... 105205784 U

(51) Int. Cl.

| | |
|---|---|
| ***E06B 9/303*** | (2006.01) |
| ***E06B 9/384*** | (2006.01) |
| ***E06B 9/262*** | (2006.01) |
| ***E06B 9/28*** | (2006.01) |
| ***E06B 9/386*** | (2006.01) |
| ***E06B 9/382*** | (2006.01) |

(52) U.S. Cl.

CPC ..... *E06B 9/384* (2013.01); *E06B 9/262* (2013.01); *E06B 9/28* (2013.01); *E06B 9/382* (2013.01); *E06B 9/386* (2013.01); *E06B 2009/2622* (2013.01)

(58) Field of Classification Search

CPC . E06B 9/382; E06B 9/384; E06B 9/90; E06B 9/303; E06B 9/262; E06B 2009/2622

USPC ..... 160/84.01, 84.03, 168.1 R, 173 R, 236

See application file for complete search history.

(56) References Cited

U.S. PATENT DOCUMENTS

| | | | | |
|---|---|---|---|---|
| 1,784,679 A * | 12/1930 | Paterson | ..... | B65D 63/14 24/129 B |
| 2,481,714 A * | 9/1949 | Bezjian | ..... | E06B 9/303 160/168.1 R |
| 2,482,036 A * | 9/1949 | Stutz | ..... | E06B 9/388 160/173 R |
| 2,513,895 A * | 7/1950 | Seagaard | ..... | E06B 9/386 160/173 R |

(Continued)

*Primary Examiner* — Katherine W Mitchell
*Assistant Examiner* — Johnnie A. Shablack

(57) ABSTRACT

A window shade includes a top box, a bottom bar and a shade connected between the top box and the bottom bar. Multiple wire units extend through holes of the shade. Each wire unit includes two connection wires and multiple cross wires which are spaced and transversely connected between the connection wires. Each wire unit has an operation wire for controlling the shade, the operation wire alternatively extends between the cross wires along the longitudinal direction of the shade. The holes in the shade each include two passages formed at two inner ends thereof. The connection wires extend through the two passages. At least one tooth extends from each of two insides of each of the holes and located between the two passages. When the wire unit is pulled outward, the cross wires are restricted by the teeth so that the operation wire is restricted from being pull out.

7 Claims, 8 Drawing Sheets

(56) References Cited

U.S. PATENT DOCUMENTS 2,523,038 A * 9/1950 Mayer ..... E06B 9/384 160/173 R
2,670,037 A * 2/1954 Hunter ..... E06B 9/384 160/173 R
4,487,243 A * 12/1984 Debs ..... E06B 9/303 160/168.1 R
4,621,673 A * 11/1986 Georgopoulos ..... E06B 9/32 160/168.1 R
4,945,971 A * 8/1990 Ivarsson ..... E06B 9/382 160/178.3
5,165,459 A * 11/1992 Gaber ..... E06B 9/30 160/168.1 R
5,313,998 A * 5/1994 Colson ..... E06B 9/262 156/197
5,355,928 A * 10/1994 Robertson ..... E06B 9/262 160/348
5,375,642 A * 12/1994 Gaber ..... E06B 9/32 160/168.1 R
5,632,316 A * 5/1997 Cohen ..... E06B 9/303 160/168.1 R
5,918,656 A * 7/1999 Daniels ..... E06B 9/307 160/168.1 R
6,164,363 A * 12/2000 Colson ..... E06B 9/262 160/166.1
6,318,439 B1 * 11/2001 Matsubara ..... E06B 9/307 160/115
6,405,783 B1 * 6/2002 Smith ..... E06B 9/303 160/176.1 R
6,557,615 B2 * 5/2003 Smith ..... E06B 9/303 160/176.1 R
6,619,367 B1 * 9/2003 Kawakita ..... E06B 9/28 160/172 R
6,648,048 B2 * 11/2003 Lai ..... E06B 9/303 160/113
6,739,374 B1 * 5/2004 Mouzakis ..... E06B 9/36 160/178.1 V
6,792,994 B2 * 9/2004 Lin ..... E06B 9/262 160/84.03
6,799,624 B2 * 10/2004 Smith ..... E06B 9/303 160/176.1 R
6,877,547 B2 * 4/2005 Kawakita ..... E06B 9/38 160/168.1 R
7,055,572 B2 * 6/2006 Nien ..... E06B 9/303 139/384 A
7,069,973 B2 * 7/2006 Sasaki ..... E06B 9/266 160/168.1 R
7,275,580 B2 * 10/2007 Yu ..... E06B 9/262 160/116
7,556,080 B2 * 7/2009 Nien ..... E06B 9/30 160/168.1 R
7,591,297 B2 * 9/2009 Lee ..... E06B 9/32 160/168.1 R
7,938,161 B2 * 5/2011 Lin ..... E06B 9/262 160/84.01
8,316,911 B2 * 11/2012 Cleaver ..... E06B 9/262 160/168.1 R
8,381,792 B2 * 2/2013 Perkowitz ..... E06B 9/262 160/243
8,474,507 B2 * 7/2013 Anthony ..... E06B 9/262 160/168.1 R
8,496,040 B2 * 7/2013 Palmer ..... E06B 9/324 160/173 R
8,496,041 B2 * 7/2013 Li ..... E06B 9/303 139/384 A
8,528,172 B2 * 9/2013 Andersen ..... E06B 9/262 160/178.2
8,540,006 B1 * 9/2013 Vestal ..... E06B 9/38 160/340
8,544,522 B2 * 10/2013 Lin ..... E06B 9/262 160/178.3
8,783,330 B2 * 7/2014 Anthony ..... E06B 9/262 160/168.1 R
8,925,159 B2 * 1/2015 Chen ..... E06B 9/326 160/173 R
9,074,409 B2 * 7/2015 Liang ..... E06B 9/262
9,119,496 B2 * 9/2015 Chang ..... A47H 3/04
9,222,303 B2 * 12/2015 Anthony ..... E06B 9/262
9,512,671 B2 * 12/2016 Cha ..... D03D 11/00
2003/0062136 A1 * 4/2003 Nien ..... E06B 9/262 160/84.04
2006/0243396 A1 * 11/2006 Liang ..... E06B 9/262 160/84.06
2009/0078378 A1 * 3/2009 Cecchetti ..... E06B 9/386 160/166.1
2009/0183843 A1 * 7/2009 Chou ..... E06B 9/384 160/218
2009/0205789 A1 * 8/2009 Watkins ..... E06B 9/262 160/173 R
2010/0126674 A1 * 5/2010 Lin ..... E06B 9/262 160/84.03
2011/0203079 A1 * 8/2011 Anthony ..... E06B 9/262 24/115 F
2011/0214823 A1 * 9/2011 Hu ..... E06B 9/30 160/168.1 R
2012/0193043 A1 * 8/2012 Bishop ..... E06B 9/262 160/370
2012/0233817 A1 * 9/2012 Hsu ..... E06B 9/262 24/115 F
2013/0048233 A1 * 2/2013 Lin ..... E06B 9/326 160/168.1 R
2014/0284003 A1 * 9/2014 Cha ..... E06B 9/384 160/84.04
2015/0013920 A1 * 1/2015 Mullet ..... E06B 9/303 160/7
2016/0053532 A1 * 2/2016 Zhang ..... E06B 9/262 160/84.04
2016/0069129 A1 * 3/2016 Lin ..... E06B 9/26 160/84.04

* cited by examiner

RESTRICTION DEVICE FOR RESTRICTING WIRES FROM BEING PULLED OUT FROM SHADE

BACKGROUND OF THE INVENTION

1. Fields of the Invention

The present invention relates to window shades, and more particularly, to a restriction device for restricting wires of the shades from being pulled out.

2. Descriptions of Related Art

The conventional window shades generally comprise multiple slats and multiple wires extend through the slats and are connected between the control unit in the top box and the bottom bar. By operating the wires, the wires are pulled upward or expanded downward to fold the shade or expand the shade. However, the wires are exposed and can be easily pulled out from the shades, and the pulled wires may be wrapped to limbs of kids. A restriction device is developed and comprises multiple control wire units, and each control wire unit has spaced wires, multiple operation wires and multiple support wires. Each spaced wire has two lateral wires. Multiple connection wires connected transversely to the lateral wires and the spaced wires. The support wires are located at inside of the spaced wires and are used to train the slats. The operation wires alternatively extend between the spaced wires and the connection wires. The connection wires are connected between the spaced wires and the lateral wires. The operation wires are respectively wrapped to multiple transmission units. The slats are located between the support wires so that when operating the control wire units, the operation wires are restricted by connection wires between the spaced wires and the lateral wires so that the operation wires cannot be pulled out from the slats to increase the safety feature. The space between the connection wires is limited so as to restrict the operation wires from being pulled out.

However, the restriction device is complicated and the assembling cost is increased. Because the operation wires alternatively extend between the spaced wires and the connection wires, and the space between the connection wires is limited to restrict the operation wires from being pulled out, so that when the operation wires are pulled, the whole control wire unit is pulled outward, and this pulling action may increase the space between the connection wires, and the safety feature may be affected.

The present invention intends to provide a restriction device for effectively restricting wires of the shades from being pulled out.

SUMMARY OF THE INVENTION

The present invention relates to a window shade and comprises a top box, a bottom bar and a shade connected between the top box and the bottom bar. Multiple wire units extend through holes of the shade. Each wire unit has two connection wires and multiple cross wires which are spaced from each other and transversely connected between the connection wires. The connection wires are connected between the top box and the bottom bar. Each wire unit has an operation wire for controlling the shade and the operation wire has a first end connected to a transmission mechanism, and a second end of the operation wire is connected to the bottom bar. The operation wire alternatively extends between the cross wires along the longitudinal direction of the shade. The holes of the shade each are an elongate hole which has two inner ends and two insides connected between the two inner ends. Each hole includes two passages formed at the two inner ends thereof, and the connection wires extend through the two passages. At least one tooth extends from each of the two insides of each of the holes and is located between the two passages. When the wire unit is pulled outward, the cross wires are restricted by the teeth so that the operation wire is restricted from being pull out.

The present invention has the following advantages which are that the function of restriction to the operation wires is achieved by the cooperation of the wire units and the holes in the shade. Each wire unit has two connection wires and multiple cross wires which are spaced from each other and transversely connected between the connection wires. The holes of the shade each include two passages formed at the two inner ends thereof, and the connection wires extend through the two passages. At least one tooth extends from each of the two insides of each of the holes. When the wire unit is pulled outward, the cross wires are restricted by the teeth so that the operation wire is restricted from being pull out.

The structure of each wire unit is simple and includes two connection wires and multiple cross wires.

The holes defined through the slats or the shade of Roman shades are easily made. The securing units are easily manufactured with limited cost.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
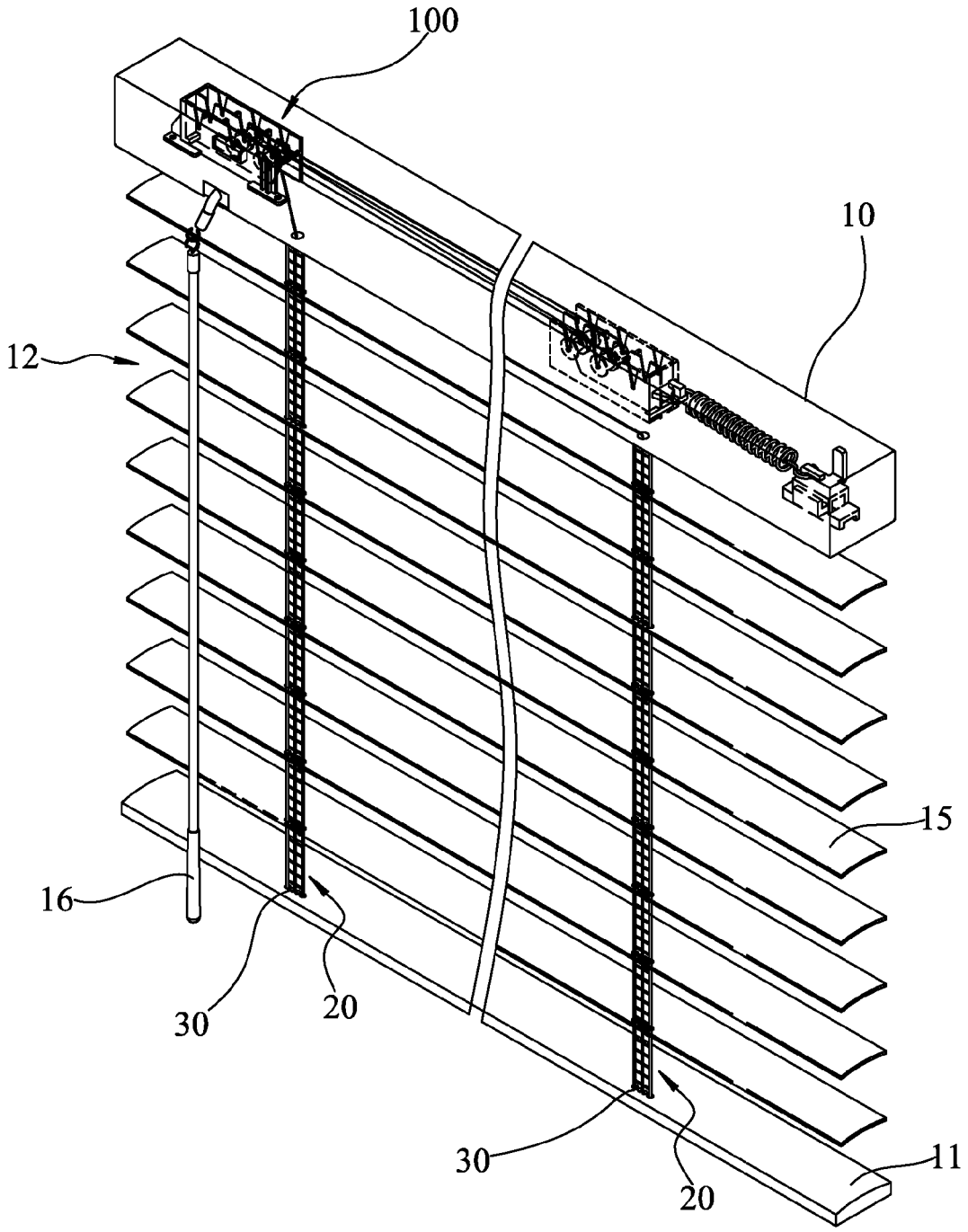
FIG. 1 is a perspective view to show the restriction device of the present invention installed to a window shade.
Figure 2:
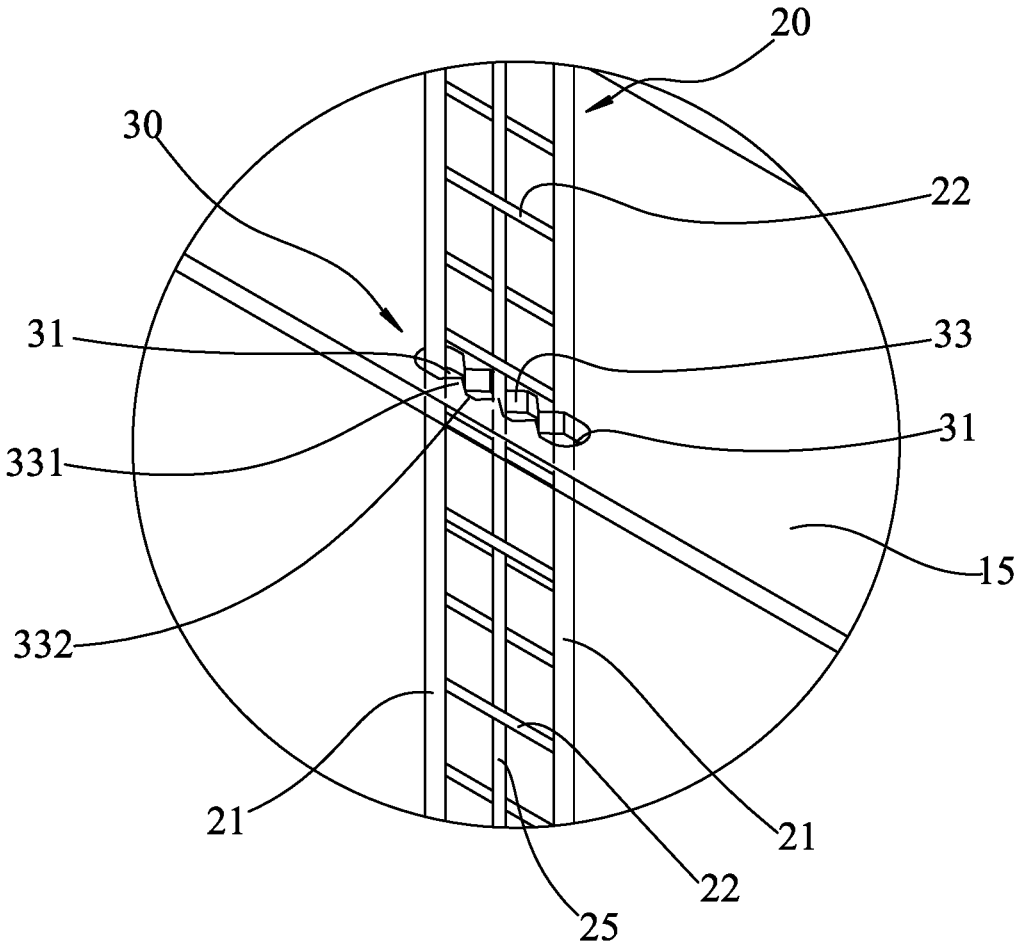
FIG. 2 is an enlarged view to show the restriction device of the present invention installed to a window shade.
Figure 3:
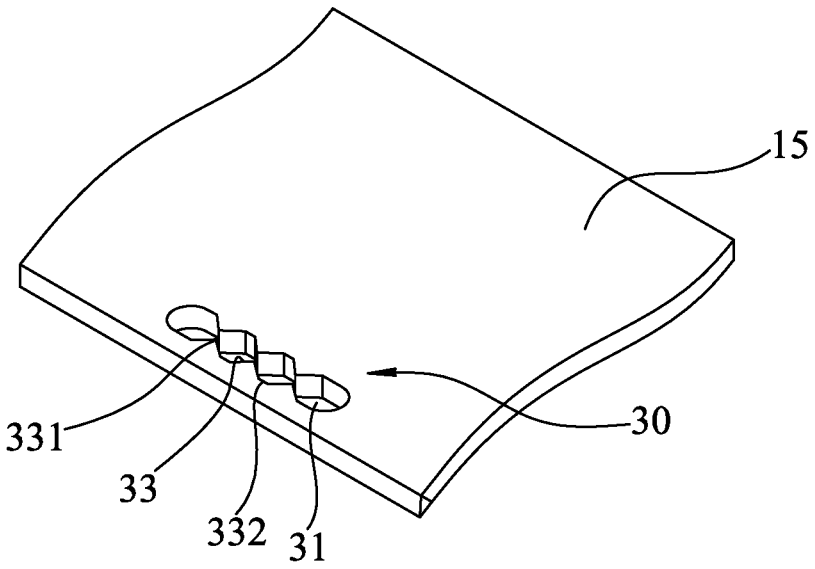
FIG. 3 is an enlarged view to show the hole of the restriction device of the present invention.
Figure 4:
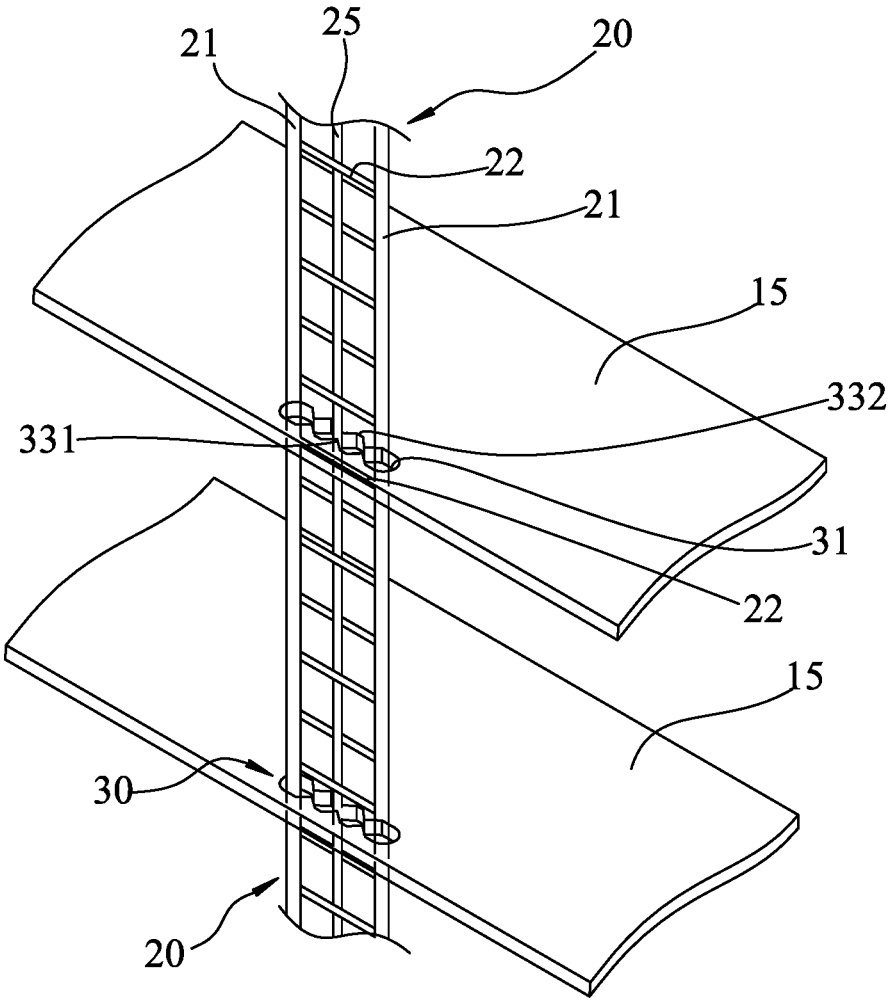
FIG. 4 shows the wire unit extends through the holes of the restriction device of the present invention.

Referring to FIGS. 1 to 4, the restriction device of the present invention is installed to a window shade which includes a top box 10, a bottom bar 11 and a shade 12 connected between the top box 10 and the bottom bar 11. The shade 12 includes multiple slats 15 and each slat 15 has two holes 30 defined therethrough. Two wire units 20 extend through the holes 30 of the shade 12 respectively. An operation wand 16 is connected to a transmission mechanism 100 in the top box 10 so as to control the angle of the slats 15.

Each wire unit 20 has two connection wires 21 and multiple cross wires 22 which are spaced from each other and transversely connected between the connection wires 21. The connection wires 21 are connected between the top box 10 and the bottom bar 11. Each wire unit 20 has an operation wire 25 for controlling the shade 12, and the operation wire 25 has the first end thereof connected to a transmission mechanism 100 in the top box 10, and the second end of the operation wire 25 is connected to the bottom bar 11. The operation wire 25 alternatively extends between the cross wires 22 along the longitudinal direction of the shade 12. Preferably, the operation wire 25 of each wire unit 20 is located at the middle portion of each of the cross wires 22. The outer diameter of each of the cross wires 22 is less than that of the operation wire 25.

The holes 30 of the shade 12 each are an elongate hole which has two inner ends and two insides are connected between the two inner ends. Each hole 30 includes two passages 31 formed at the two inner ends thereof. The connection wires 21 extend through the two passages 31. Two teeth 33 extend from each of the two insides of each of the holes 30 and are located between the two passages 31. Each of the teeth 33 defines a peak 331 and a valley 332, wherein the respective peaks 331 of the two insides of the hole 33 are located corresponding to each other, and the respective valleys 332 of the two insides of the hole 33 are located corresponding to each other.

Figure 5:
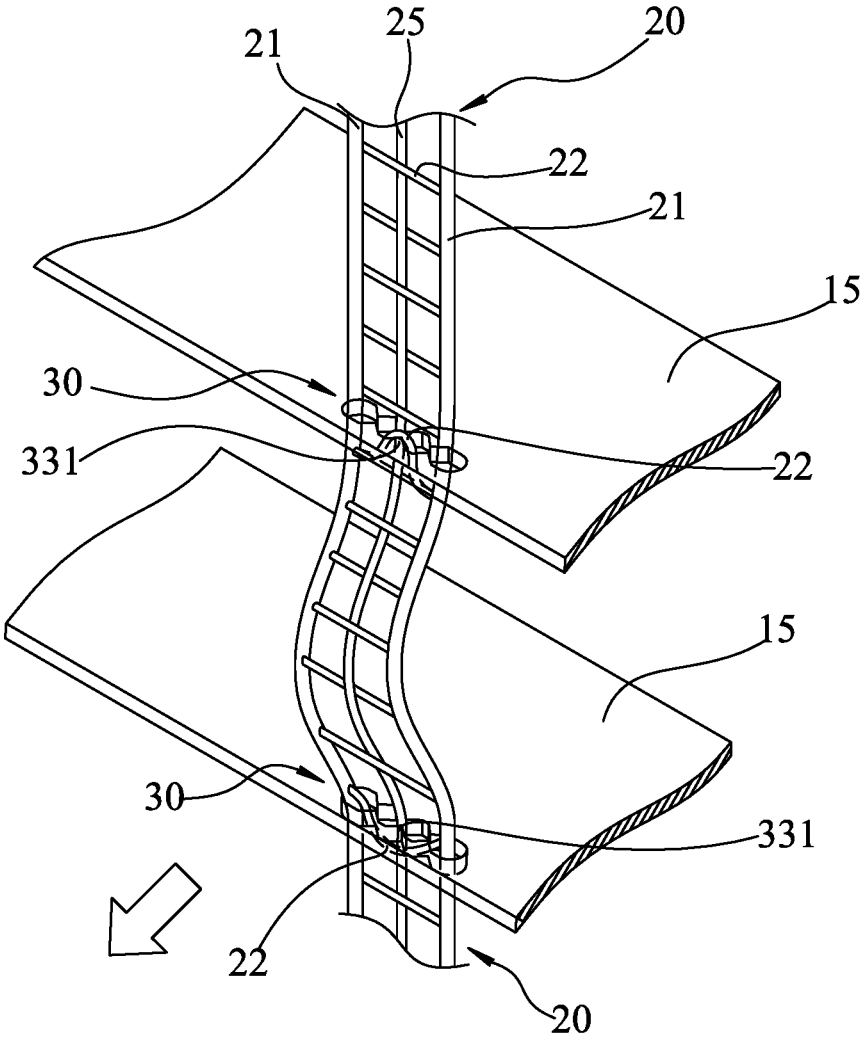
FIG. 5 shows that when the wire unit is pulled.

When the wire unit 20 is pulled outward, as shown in FIG. 5, the cross wires 22 are restricted by peaks 331 of the teeth 33 so that the cross wires 22 can only be pulled for a limited distance, and this means that the operation wire 25 is restricted from being pull out by the interference of the cross wires 22 and the teeth 33.

Figure 6:
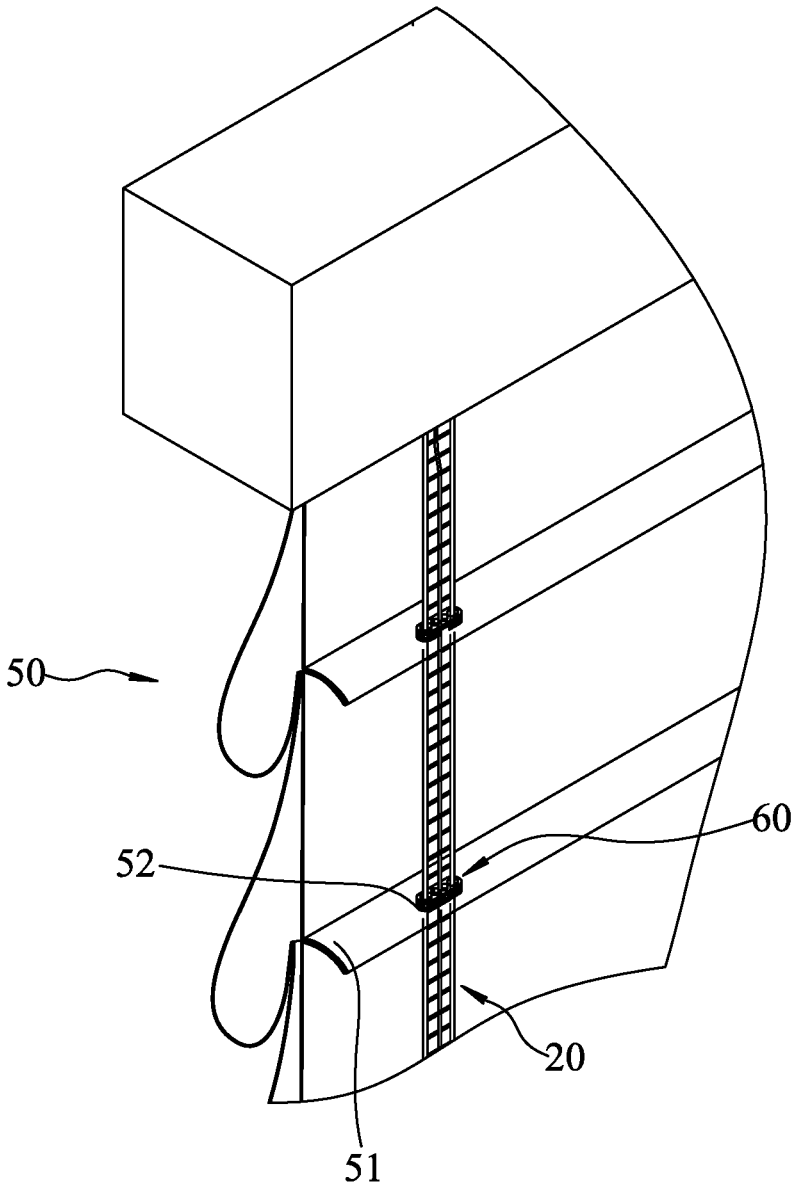
FIG. 6 shows that the restriction device of the present invention is installed to a Roman shade.
Figure 7:
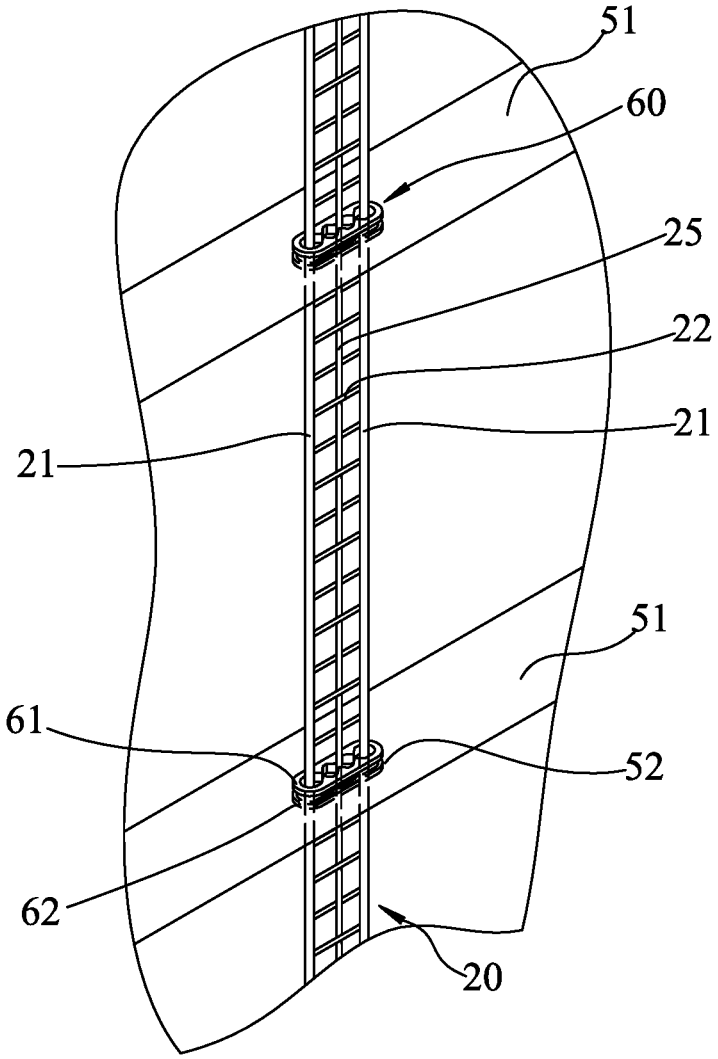
FIG. 7 shows the wire unit extends through the holes in the securing units of the restriction device of the present invention.
Figure 8:
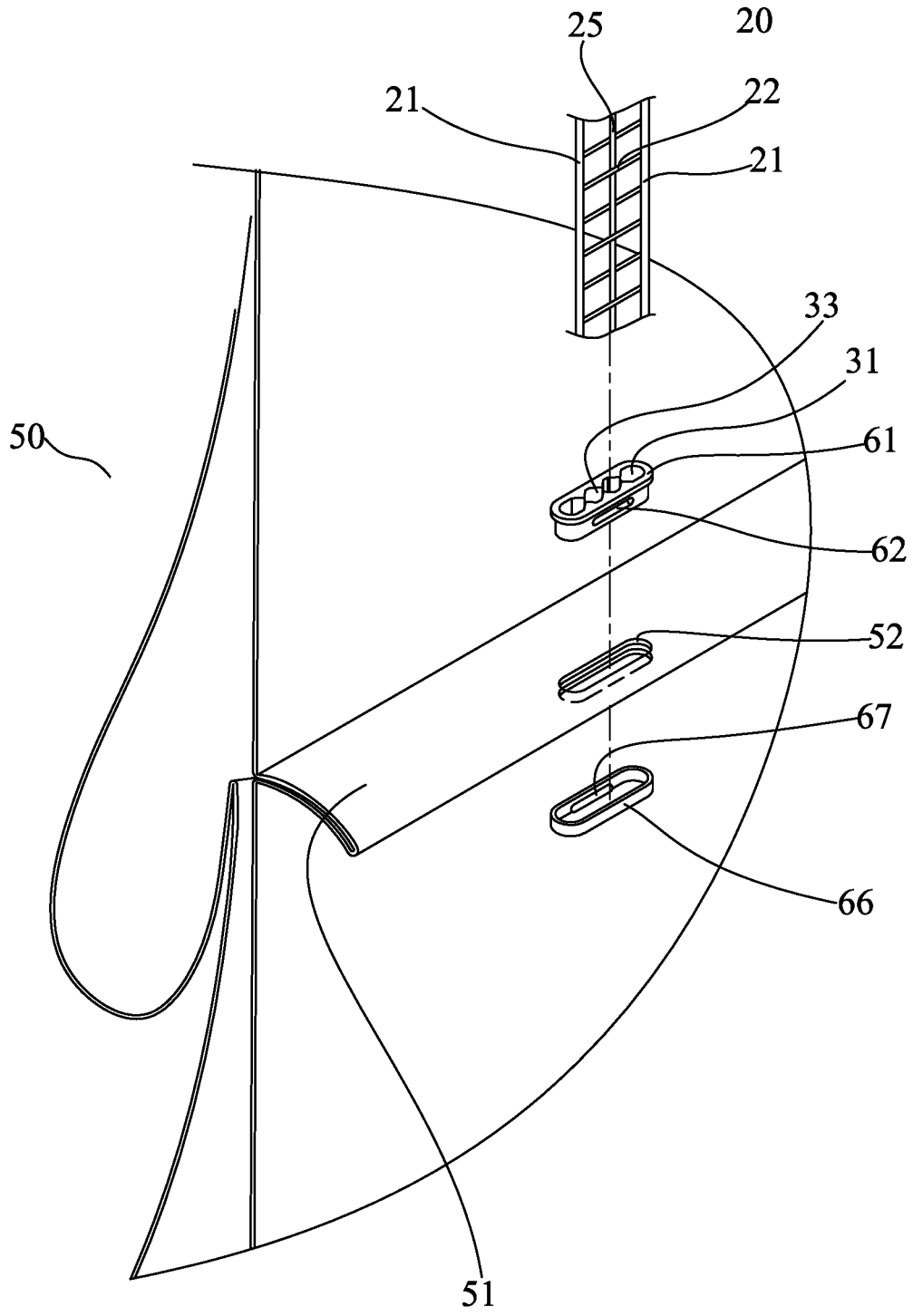
FIG. 8 is an exploded view to show the securing unit of the restriction device of the present invention.

As shown in FIGS. 6 to 8, the present invention can be used to a Roman shade 50. The Roman shade 50 includes multiple folding sections 51 which have the holes 33 defined therethrough. Each slot 52 accommodates a securing unit 60 therein. Each of the securing unit 60 includes a first engaging member 61 and a second engaging member 66 which is engaged with the first engaging member 61. The first engaging member 61 has the hole 30 defined therethrough. The first engaging member 61 and the second engaging member 66 are respectively located on two opposite sides of the folding section 51 corresponding thereto. The first engaging member 61 includes an insertion extending therefrom and a first engaging portion 62 formed on the insertion. The insertion is inserted into the second engaging member 66 which has a second engaging portion 67 which is engaged with the first engaging portion 62.

The hole 30 is the same as the previous embodiment and includes two inner ends and two insides which are connected between the two inner ends. Each hole 30 includes two passages 31 formed at the two inner ends thereof. The connection wires 21 extend through the two passages 31. Two teeth 33 extend from each of the two insides of each of the holes 30 and are located between the two passages 31. Each of the teeth 33 defines a peak 331 and a valley 332. The respective peaks 331 of the two insides of the hole 33 are located corresponding to each other, and the respective valleys 332 of the two insides of the hole 33 are located corresponding to each other. When the wire unit 20 is pulled outward, the cross wires 22 are restricted by peaks 331 of the teeth 33 so that the operation wire 25 is prevented from being pulled out for a long length.

While we have shown and described the embodiment in accordance with the present invention, it should be clear to those skilled in the art that further embodiments may be made without departing from the scope of the present invention.

What is claimed is:

1. A window shade comprising: a top box having a transmission mechanism, a bottom bar, and a shade connected between the top box and the bottom bar, the shade having multiple groups of holes defined therethrough, and multiple wire units, each of the wire units passing through the holes of a respective group of the multiple groups of holes of the shade;

wherein each wire unit has two connection wires extending longitudinally through the holes of the respective group of holes, and each wire unit further includes multiple cross wires, the cross wires spaced from each other, and each cross wire transversely connected between the connection wires of the respective wire unit, the connection wires connected between the top box and the bottom bar, and each wire unit further includes an operation wire for controlling the shade, each operation wire having a first end connected to the transmission mechanism and a second end connected to the bottom bar, each operation wire alternatingly extending over or under the cross wires of the respective wire unit along a longitudinal direction of the shade, and each hole of the multiple groups of holes being an elongate hole having two inner end surfaces and two opposing transverse inside surfaces connected between the two inner end surfaces, each hole including two passages formed at the two inner end surfaces thereof, each connection wire of the respective wire unit extending through a respective one of the two passages, and at least one tooth extending from each of the two opposing transverse inside surfaces and located between the two passages for engaging at least one of the cross wires when the respective wire unit is pulled outward.

2. The window shade as claimed in claim 1, wherein the shade includes multiple slats, wherein the holes of the respective group of holes are defined through each slat.

3. The window shade as claimed in claim 1, wherein the operation wire of each wire unit is located at a middle portion of each of the respective cross wires.

4. The window shade as claimed in claim 1, wherein each tooth defines a peak and a valley, wherein the peak and valley of the at least one tooth on one of the two opposing transverse inside surfaces respectively corresponds to the peak and valley of the at least one tooth on the other of the two opposing transverse inside surfaces.

5. The window shade as claimed in claim 1, wherein the shade is a Roman shade and includes multiple folding sections, wherein the holes of the respective group of holes are defined through each of the folding sections.

6. The window shade as claimed in claim 5, wherein the folding sections each have multiple slots defined therethrough, each slot corresponding to the holes of the multiple groups of holes, each slot accommodating a securing unit therein, each of the securing units including a first engaging member and a second engaging member engaged with the first engaging member, the first engaging member having the corresponding hole defined therethrough, and the first engaging member and the second engaging member are respectively located on two opposite sides of the folding section corresponding thereto.

7. The window shade as claimed in claim 6, wherein each first engaging member includes an insertion extending therefrom and a first engaging portion formed on the insertion, each second engaging member has a second engaging portion which is engaged with the respective first engaging portion.

* * * * *